US011268221B2

(12) United States Patent
Kohinata

(10) Patent No.: US 11,268,221 B2
(45) Date of Patent: Mar. 8, 2022

(54) NONWOVEN FABRIC

(71) Applicant: Sumitomo Chemical Company, Limited, Tokyo (JP)

(72) Inventor: Yusaku Kohinata, Tokyo (JP)

(73) Assignee: SUMITOMO CHEMICAL COMPANY, LIMITED, Tokyo (JP)

( * ) Notice: Subject to any disclaimer, the term of this patent is extended or adjusted under 35 U.S.C. 154(b) by 0 days.

(21) Appl. No.: 16/489,433

(22) PCT Filed: Feb. 21, 2018

(86) PCT No.: PCT/JP2018/006302
§ 371 (c)(1),
(2) Date: Aug. 28, 2019

(87) PCT Pub. No.: WO2018/159422
PCT Pub. Date: Sep. 7, 2018

(65) Prior Publication Data

US 2019/0390381 A1 Dec. 26, 2019

(30) Foreign Application Priority Data

Mar. 3, 2017 (JP) ..... JP2017-040365

(51) Int. Cl.
*D04H 3/009* (2012.01)

(52) U.S. Cl.
CPC ..... *D04H 3/009* (2013.01)

(58) Field of Classification Search
CPC ..... D04H 3/009; C08L 81/06; C08G 75/20; C08G 75/205; C08G 75/23
See application file for complete search history.

(56) References Cited

U.S. PATENT DOCUMENTS 6,280,880 B1 * 8/2001 Schwoebel ..... D04H 3/009 429/251
2007/0212615 A1 * 9/2007 Jost ..... H01M 10/0569 429/326
2009/0047515 A1 * 2/2009 Kohinata ..... D01D 5/0038 428/364
2010/0018934 A1 * 1/2010 Ferrer ..... B01D 39/1623 210/774
2011/0206971 A1 * 8/2011 Hennige ..... B01D 67/0048 429/144

(Continued)

FOREIGN PATENT DOCUMENTS

CN 102443970 A 5/2012
CN 102482412 A 5/2012

(Continued)

OTHER PUBLICATIONS

Int'l Search Report dated May 1, 2018 in Int'l Application No. PCT/JP2018/006302.

(Continued)

*Primary Examiner* — Jeremy R Pierce
(74) *Attorney, Agent, or Firm* — Panitch Schwarze Belisario & Nadel LLP

(57) ABSTRACT

A nonwoven fabric including fibers formed from a thermoplastic resin is provided. The thermoplastic resin is an aromatic polysulfone resin. An average fiber diameter of the fibers is 3 μm or more and 8 μm or less. A basis weight is 5 g/m$^2$ or more and 30 g/m$^2$ or less.

17 Claims, 3 Drawing Sheets

(56) References Cited

U.S. PATENT DOCUMENTS

| | | | | |
|---|---|---|---|---|
| 2012/0152823 | A1* | 6/2012 | Okamoto | B01D 69/02 210/500.23 |
| 2012/0190764 | A1 | 7/2012 | Kohinata et al. | |
| 2013/0115844 | A1* | 5/2013 | Kihara | H01B 3/301 442/394 |
| 2013/0122215 | A1* | 5/2013 | Waller, Jr | D04H 1/56 427/551 |
| 2013/0150507 | A1* | 6/2013 | Gallucci | C08L 69/00 524/132 |
| 2015/0209691 | A1* | 7/2015 | Ferrer | D04H 1/728 210/799 |

FOREIGN PATENT DOCUMENTS

| | | | |
|---|---|---|---|
| CN | 204749384 | U | 11/2015 |
| JP | H08293579 | A | 11/1996 |
| JP | 2002061063 | A | 2/2002 |
| JP | 2004348984 | A | 12/2004 |
| JP | 2008308810 | A | 12/2008 |

OTHER PUBLICATIONS

Office Action dated May 24, 2021 in CN Application No. 201880015178.X.

Handbook of New Information on Synthetic Resins, Edited by Xiangxing Zhou, China Materials Publishing House, p. 600, 1st Edition (May 2002).

Office Action dated Dec. 13, 2021 in CN Application No. 201880015178.X (with English Machine Translation).

* cited by examiner

NONWOVEN FABRIC

CROSS-REFERENCE TO RELATED APPLICATION

This application is a Section 371 of International Application No PCT/JP2018/006302, filed Feb. 21, 2018, which was published in the Japanese language on Sep. 7, 2018 under International Publication No. WO 2018/159422 A1, which claims priority under 35 U.S.C. § 119(b) to Japanese Application No. 2017-040365, filed Mar. 3, 2017, the disclosures of which are incorporated herein by reference in their entirety.

TECHNICAL FIELD

The present invention relates to a nonwoven fabric.

BACKGROUND ART

Conventionally, laminated substrates in which a plurality of prepregs having a circuit pattern formed on the surface thereof are laminated via different materials have been known (see, for example, Patent Document 1). These laminated substrates are usually formed by thermocompression bonding of the laminated substrates before adhesion. Examples of conventionally used prepregs include those in which a reinforcing fiber such as a glass fiber or a carbon fiber is impregnated with an epoxy resin.

CITATION LIST

Patent Document

[Patent Document 1] Japanese Unexamined Patent Application, First Publication No. Hei 08-293579

SUMMARY OF INVENTION

Technical Problem

However, in such a configuration, the adhesive force between the prepreg and the different material is not necessarily sufficient. As a result, there is a possibility that the layers may be separated at the time of secondary processing of the laminated substrate or at the time of using a printed circuit board. In addition, it is expected that the low adhesive force with the epoxy resin will also be a problem in the members other than the laminated substrate.

The present invention has been made in view of such circumstances, with an object of providing a material excellent in compatibility with an epoxy resin.

Solution to Problem

The inventors of the present invention have conducted intensive studies in order to solve the abovementioned problems by roughening the surface of the different material and increasing the contact area at the interface between the prepreg and a different kind of base material. Examples of different materials with rough surfaces include nonwoven fabrics. As a forming material of these nonwoven fabrics, general purpose resins such as polyolefin-based resins are mainly used.

However, general purpose resins such as polyolefin-based resins are inferior in compatibility with epoxy resins. Therefore, it is assumed that the interface between the prepreg and the nonwoven fabric formed using such a resin is likely to be detached.

Accordingly, the inventors of the present invention discovered that a nonwoven fabric excellent in compatibility with an epoxy resin can solve the above-mentioned problems, and completed the present invention.

That is, the present invention includes the following aspects.

[1] A nonwoven fabric including fibers formed from a thermoplastic resin, wherein the aforementioned thermoplastic resin is an aromatic polysulfone resin, an average fiber diameter of the aforementioned fibers is 3 μm or more and 8 μm or less, and a basis weight is 5 g/m$^2$ or more and 30 g/m$^2$ or less.

[2] The nonwoven fabric according to [1], wherein a content of a repeating unit represented by the following formula (1) in the aforementioned aromatic polysulfone resin is from 80 mol % to 100 mol % with respect to the total amount (number of moles) of all the repeating units constituting the aforementioned aromatic polysulfone resin, $$-Ph^1-SO_2-Ph^2-O— \quad (1)$$

[In formula (1), $Ph^1$ and $Ph^2$ each independently represent a phenylene group, and at least one hydrogen atom in the aforementioned phenylene group may each independently be substituted with an alkyl group having 1 to 10 carbon atoms, an aryl group having 6 to 20 carbon atoms or a halogen atom.]

Advantageous Effects of Invention

According to one aspect of the present invention, a material (nonwoven fabric) excellent in compatibility with an epoxy resin is provided.

DESCRIPTION OF EMBODIMENTS

<Nonwoven Fabric>

Figure 1:
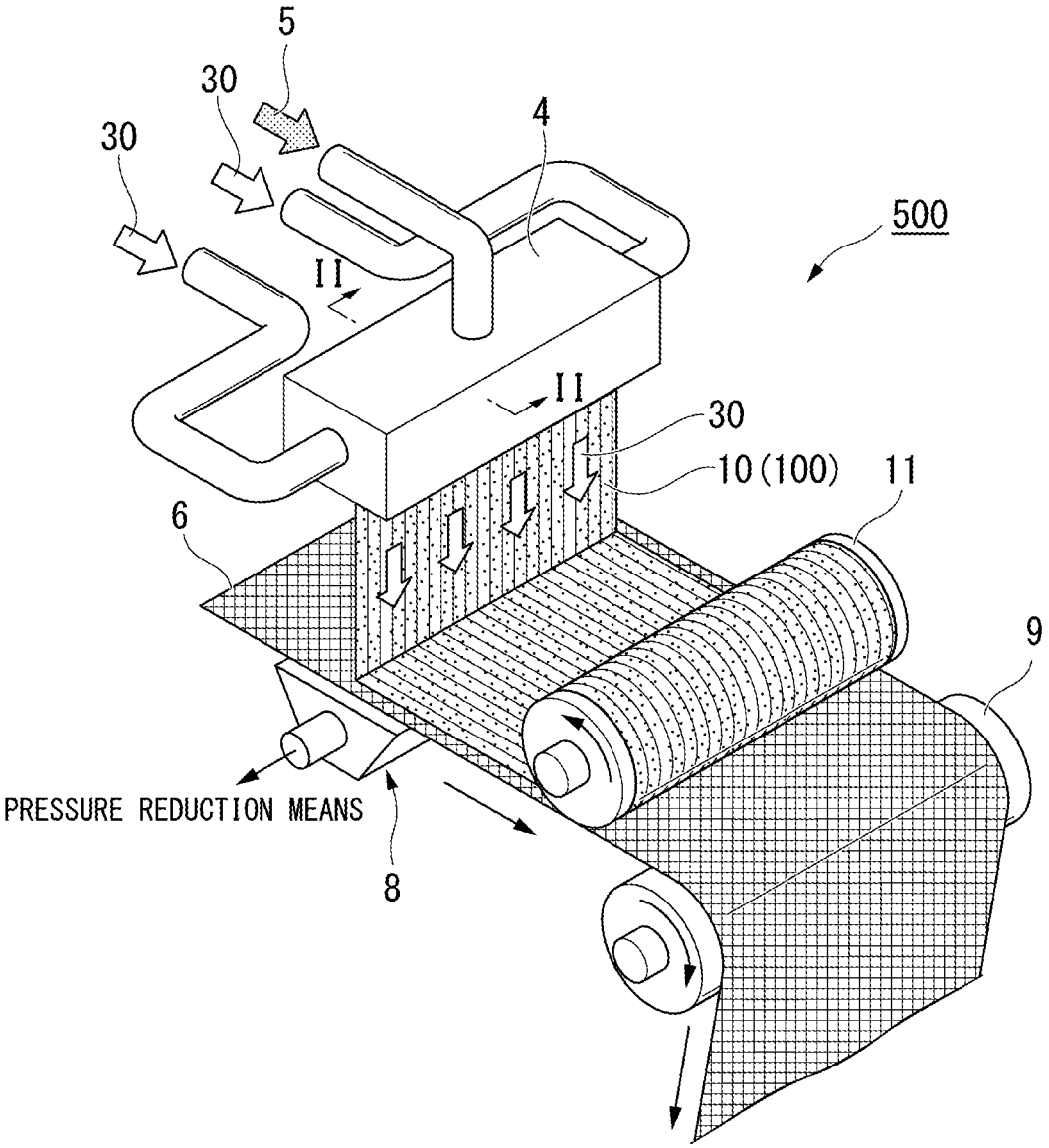
FIG. 1 is a schematic perspective view showing a conventional melt blowing apparatus.

Hereinafter, a nonwoven fabric according to an embodiment of the present invention will be described with reference to FIGS. 1 to 4. It should be noted that in the drawings, in order to make the drawings easier to see, dimensions, ratios and the like of each constituent are appropriately changed.

The nonwoven fabric of the present embodiment is a nonwoven fabric composed of fibers formed from a thermoplastic resin. Further, the thermoplastic resin according to the nonwoven fabric of the present embodiment is an aromatic polysulfone resin.

It should be noted that the term "nonwoven fabric" in the present specification refers to a sheet-like product with specific properties in which fibers are not woven but are intertwined, fibers are oriented in one direction or at random, and fibers are bonded with each other by fusion.

The basis weight of the nonwoven fabric of the present embodiment is 5 $g/m^2$ or more and 30 $g/m^2$ or less. It should be noted that the "basis weight" of the nonwoven fabric in the present embodiment is a unit defined in JIS L 0222: 2001 "Glossary of terms used in nonwoven industry". That is, the "basis weight" of the nonwoven fabric in the present embodiment is a unit representing the mass per unit area, which means the number of grams per 1 $m^2$ of the nonwoven fabric.

An average fiber diameter of the fibers formed from the aromatic polysulfone resin is 3 μm or more and 8 μm or less. It should be noted that the average fiber diameter of the nonwoven fabric in the present embodiment is a value obtained by enlarging and photographing the nonwoven fabric with a scanning electron microscope, measuring diameters of 20 arbitrary fibers from the obtained photograph, and averaging the sum thereof.

The thickness of the nonwoven fabric of the present embodiment is preferably from 10 to 100 μm. The "thickness of the nonwoven fabric" can be measured by a micrometer.

In one aspect, the nonwoven fabric of the present embodiment may contain other components in addition to the fibers formed from the aromatic polysulfone resin, and the content of the other component may be from 0.1 to 30% by mass with respect to the total mass of the nonwoven fabric. Examples of the other component include residual solvents, antioxidants, heat resistant processing stabilizers and viscosity modifiers.

In another aspect, the nonwoven fabric of the present embodiment may be composed only of fibers formed from an aromatic polysulfone resin.

This will be described below.

[Aromatic Polysulfone Resin]

Aromatic polysulfone resins are known to be excellent in heat resistance and mechanical properties. In addition, it is known that aromatic polysulfone resins exhibit excellent compatibility with epoxy resins. The inventors of the present invention focused on these features and considered that it was possible to solve the problems of the present application by the nonwoven fabric which uses an aromatic polysulfone resin as a forming material. Therefore, it is expected that the nonwoven fabric which uses an aromatic polysulfone resin as a forming material can be suitably used for applications requiring excellent heat resistance and mechanical properties. Further, it is expected that the nonwoven fabric which uses an aromatic polysulfone resin as a forming material can be suitably used for applications to be used with an epoxy resin.

The aromatic polysulfone resin according to the nonwoven fabric of the present embodiment is typically a resin including a repeating unit that contains a divalent aromatic group (a residue obtained by removing, from an aromatic compound, two hydrogen atoms bonded to its aromatic ring), a sulfonyl group (—$SO_2$—) and an oxygen atom.

The aromatic polysulfone resin preferably has a repeating unit represented by a formula (1) (hereinafter sometimes referred to as "repeating unit (1)") from the viewpoint of improving the heat resistance and chemical resistance. In the present specification, the aromatic polysulfone resin having the repeating unit (1) may be referred to as an "aromatic polyether sulfone resin". The aromatic polysulfone resin according to the present invention may further have, in addition to the repeating unit (1), at least one other repeating unit such as a repeating unit represented by a formula (2) (hereinafter sometimes referred to as "repeating unit (2)") and a repeating unit represented by a formula (3) (hereinafter sometimes referred to as "repeating unit (3)").

In a method for producing the nonwoven fabric of the present embodiment, it is preferable to use an aromatic polysulfone resin having 80 mol % to 100 mol % of the repeating unit represented by the formula (1) with respect to the total amount (number of moles) of all the repeating units constituting the aromatic polysulfone resin.

$$-Ph^1-SO_2-Ph^2-O— \quad (1)$$

[In formula (1), $Ph^1$ and $Ph^2$ each independently represent a phenylene group, and at least one hydrogen atom in the aforementioned phenylene group may each independently be substituted with an alkyl group having 1 to 10 carbon atoms, an aryl group having 6 to 20 carbon atoms or a halogen atom.]

$$-Ph^3-R-Ph^4-O— \quad (2)$$

[In formula (2), $Ph^3$ and $Ph^4$ represent a phenylene group, and at least one hydrogen atom in the aforementioned phenylene group may each independently be substituted with an alkyl group having 1 to 10 carbon atoms, an aryl group having 6 to 20 carbon atoms or a halogen atom; and R represents an alkylidene group having 1 to 5 carbon atoms, an oxygen atom or a sulfur atom.]

$$-(Ph^5)_n-O— \quad (3)$$

[In formula (3), $Ph^5$ represents a phenylene group, and at least one hydrogen atom in the aforementioned phenylene group may each independently be substituted with an alkyl group having 1 to 10 carbon atoms, an aryl group having 6 to 20 carbon atoms or a halogen atom; and n represents an integer of 1 to 3, and when n is 2 or more, a plurality of $Ph^5$ groups may be the same or different from each other.]

The phenylene group represented by any one of $Ph^1$ to $Ph^5$ may be each independently a p-phenylene group, an m-phenylene group or an o-phenylene group, but it is preferably a p-phenylene group.

Examples of the alkyl group having 1 to 10 carbon atoms which may substitute the hydrogen atom in the phenylene group include a methyl group, an ethyl group, an n-propyl group, an isopropyl group, an n-butyl group, an isobutyl group, a sec-butyl group, a tert-butyl group, an n-pentyl group, an n-hexyl group, an n-heptyl group, a 2-ethylhexyl group, an n-octyl group and an n-decyl group.

Examples of the aryl group having 6 to 20 carbon atoms which may substitute the hydrogen atom in the phenylene group include a phenyl group, an o-tolyl group, an m-tolyl group, a p-tolyl group, a 1-naphthyl group and a 2-naphthyl group.

Examples of the halogen atom which may substitute the hydrogen atom in the phenylene group include a fluorine atom, a chlorine atom, a bromine atom and an iodine atom.

In the case where the hydrogen atom in the phenylene group is substituted with these groups, the number thereof, for each of the above phenylene groups, is preferably each independently 2 or less, and more preferably 1.

Examples of the alkylidene group having 1 to 5 carbon atoms represented by R include a methylene group, an ethylidene group, an isopropylidene group and a 1-butylidene group.

It is more preferable that the aromatic polysulfone resin according to the nonwoven fabric of the present embodiment have only the repeating unit (1) as the repeating unit. It should be noted that the aromatic polysulfone resin may have two or more of the repeating units (1) to (3) independently of each other.

The reduced viscosity (unit: dL/g) of the aromatic polysulfone resin according to the nonwoven fabric of the present embodiment is preferably 0.25 or more, and more preferably 0.30 or more and 0.50 or less. Usually, it can be said that the molecular weight of the resin increases as the value of the reduced viscosity increases. When the reduced viscosity of the aromatic polysulfone resin is in the above range, sufficient mechanical strength can be obtained when formed into the nonwoven fabric.

The reduced viscosity of the aromatic polysulfone resin according to the nonwoven fabric of the present embodiment is a value measured at 25° C. with an Ostwald type viscosity tube using an N,N-dimethylformamide solution having a concentration of the aromatic polysulfone resin of 1 g/dL.

[Method for Producing Aromatic Polysulfone Resin]

The aromatic polysulfone resin forming the nonwoven fabric of the present embodiment can be suitably produced by polycondensation of the corresponding aromatic dihalogenosulfone compound and the aromatic dihydroxy compound in a polar organic solvent using an alkali metal salt of carbonic acid as a base. For example, a resin having the repeating unit (1) can be suitably produced by using a compound represented by the following formula (4) (hereinafter sometimes referred to as "compound (4)") as an aromatic dihalogenosulfone compound, and using a compound represented by the following formula (5) (hereinafter sometimes referred to as "compound (5)") as an aromatic dihydroxy compound. Further, a resin having the repeating unit (1) and the repeating unit (2) can be suitably produced by using the compound (4) as an aromatic dihalogenosulfone compound, and using a compound represented by the following formula (6) (hereinafter sometimes referred to as "compound (6)") as an aromatic dihydroxy compound. Moreover, a resin having the repeating unit (1) and the repeating unit (3) can be suitably produced by using the compound (4) as an aromatic dihalogenosulfone compound, and using a compound represented by the following formula (7) (hereinafter sometimes referred to as "compound (7)") as an aromatic dihydroxy compound.

$$X^1\text{-}Ph^1\text{-}SO_2\text{-}Ph^2\text{-}X^2 \quad (4)$$

[In formula (4), $X^1$ and $X^2$ each independently represent a halogen atom; and $Ph^1$ and $Ph^2$ are the same as defined above.]

$$HO\text{-}Ph^1\text{-}SO_2\text{-}Ph^2\text{-}OH \quad (5)$$

[In formula (5), $Ph^1$ and $Ph^2$ are the same as defined above.]

$$HO\text{-}Ph^3\text{-}R\text{-}Ph^4\text{-}OH \quad (6)$$

[In formula (6), $Ph^3$, $Ph^4$ and R are the same as defined above.]

$$HO\text{-}(Ph^5)n\text{-}OH \quad (7)$$

[In formula (7), $Ph^5$ and n are the same as defined above.]

Examples of the compound (4) include bis(4-chlorophenyl) sulfone and 4-chlorophenyl-3',4'-dichlorophenyl sulfone. Examples of the compound (5) include bis(4-hydroxyphenyl) sulfone, bis(4-hydroxy-3,5-dimethylphenyl) sulfone and bis(4-hydroxy-3-phenylphenyl) sulfone. Examples of the compound (6) include 2,2-bis(4-hydroxyphenyl) propane, 2,2-bis(4-hydroxyphenyl) hexafluoropropane, bis(4-hydroxyphenyl) sulfide, bis(4-hydroxy-3-methylphenyl) sulfide and bis(4-hydroxyphenyl) ether. Examples of the compound (7) include hydroquinone, resorcin, catechol, phenylhydroquinone, 4,4'-dihydroxybiphenyl, 2,2'-dihydroxybiphenyl, 3,5,3',5'-tetramethyl-4,4'-dihydroxybiphenyl, 2,2'-diphenyl-4,4'-dihydroxybiphenyl and 4,4'''-dihydroxy-p-quaterphenyl.

It should be noted that examples of the aromatic dihalogenosulfone compound other than the compound (4) include 4,4'-bis(4-chlorophenylsulfonyl) biphenyl. Further, instead of all or part of either or both of the aromatic dihalogenosulfone compound and the aromatic dihydroxy compound, a compound having a halogeno group and a hydroxyl group in a molecule such as 4-hydroxy-4'-(4-chlorophenylsulfonyl) biphenyl can also be used.

The alkali metal salt of carbonic acid may be an alkali carbonate which is a normal salt, an alkali bicarbonate which is an acid salt (also referred to as an alkali hydrogen carbonate), or a mixture of both. As the alkali carbonate, sodium carbonate or potassium carbonate is preferably used, and as the alkali bicarbonate, sodium bicarbonate or potassium bicarbonate is preferably used.

Examples of the polar organic solvent include dimethylsulfoxide, 1-methyl-2-pyrrolidone, sulfolane (also referred to as 1,1-dioxothiolane), 1,3-dimethyl-2-imidazolidinone, 1,3-diethyl-2-imidazolidinone, dimethyl sulfone, diethyl sulfone, diisopropyl sulfone and diphenyl sulfone.

The amount of the aromatic dihalogenosulfone compound used is usually from 95 to 110 mol %, and preferably from 100 to 105 mol %, with respect to the aromatic dihydroxy compound. The intended reaction is the dehydrohalogenation polycondensation of an aromatic dihalogenosulfone compound and an aromatic dihydroxy compound. If no side reaction occurs, the closer the molar ratio of the two is to 1:1, that is, the closer the amount of the aromatic dihalogenosulfone compound used is to 100% by mole with respect to the aromatic dihydroxy compound, the higher the degree of polymerization of the obtained aromatic polysulfone resin. As a result, the reduced viscosity of the obtained aromatic polysulfone resin tends to be high. However, in reality, since side reactions such as a substitution reaction of a halogeno group to a hydroxyl group or depolymerization occur by the alkali hydroxide or the like which is produced as a by-product, and the degree of polymerization of the obtained aromatic polysulfone resin is lowered by these side reactions, in consideration of the degree of these side reactions, it is necessary to adjust the amount of the aromatic dihalogenosulfone compound used so that an aromatic polysulfone resin having the predetermined reduced viscosity can be obtained.

The amount of the alkali metal salt of carbonic acid used is usually from 95 to 115% by mole, and preferably from 100 to 110% by mole, as an alkali metal, with respect to the hydroxyl group of the aromatic dihydroxy compound. If no side reaction occurs, since the intended polycondensation proceeds more rapidly as the amount of the alkali metal salt of carbonic acid used increases, the degree of polymerization of the obtained aromatic polysulfone resin becomes higher. As a result, the reduced viscosity of the obtained aromatic polysulfone resin tends to be high. However, in reality, since the same side reactions as described above are more likely to occur as the amount of the alkali metal salt of carbonic acid used increases, and the degree of polymerization of the obtained aromatic polysulfone resin is lowered by these side reactions, in consideration of the degree of these side reactions, it is necessary to adjust the amount of the alkali metal salt of carbonic acid used so that an aromatic polysulfone resin having the predetermined reduced viscosity can be obtained.

As a typical method for producing an aromatic polysulfone resin, a production method including: as a first step, dissolving an aromatic dihalogenosulfone compound and an aromatic dihydroxy compound in a polar organic solvent; as a second step, adding an alkali metal salt of carbonic acid to the solution obtained in the first step to carry out polycondensation of the aromatic dihalogenosulfone compound and the aromatic dihydroxy compound; and as a third step, removing an unreacted alkali metal salt of carbonic acid, an alkali halide generated as a by-product and the polar organic solvent from the reaction mixture obtained in the second step to obtain an aromatic polysulfone resin can be mentioned.

The dissolution temperature in the first step is usually from 40 to 180° C. Further, the polycondensation temperature in the second step is usually from 180 to 400° C. If no side reaction occurs, since the intended polycondensation proceeds more rapidly as the polycondensation temperature increases, the degree of polymerization of the obtained aromatic polysulfone resin becomes high. As a result, the reduced viscosity of the obtained aromatic polysulfone resin tends to be high. However, in reality, the same side reactions as described above are more likely to occur as the polycondensation temperature increases, and the degree of polymerization of the obtained aromatic polysulfone resin is lowered by these side reactions. Therefore, in consideration of the degree of these side reactions, it is necessary to adjust the polycondensation temperature so that an aromatic polysulfone resin having the predetermined reduced viscosity can be obtained.

Further, it is usually better to perform the polycondensation in the second step by gradually raising the temperature while removing water generated as a by-product, and after reaching the reflux temperature of the polar organic solvent, the temperature is held usually for 1 to 50 hours, and preferably for 10 to 30 hours. If no side reaction occurs, since the intended polycondensation proceeds more rapidly as the polycondensation time increases, the degree of polymerization of the obtained aromatic polysulfone resin becomes high. As a result, the reduced viscosity of the obtained aromatic polysulfone resin tends to be high. However, in reality, the same side reactions as described above are also allowed to proceed as the polycondensation time increases, and the degree of polymerization of the obtained aromatic polysulfone resin is lowered by these side reactions. Therefore, in consideration of the degree of these side reactions, it is necessary to adjust the polycondensation time so that an aromatic polysulfone resin having the predetermined reduced viscosity can be obtained.

In the third step, first, the unreacted alkali metal salt of carbonic acid and the alkali halide generated as a by-product are removed from the reaction mixture obtained in the second step by filtration, centrifugation or the like, whereby a solution in which an aromatic polysulfone resin is dissolved in a polar organic solvent can be obtained. Subsequently, an aromatic polysulfone resin can be obtained by removing a polar organic solvent from this solution. Removal of the polar organic solvent may be carried out by distilling off the polar organic solvent directly from the solution, or may be carried out by mixing the solution with a poor solvent for the aromatic polysulfone resin to precipitate the aromatic polysulfone resin, followed by separation by filtration, centrifugation or the like.

Examples of the poor solvent for the aromatic polysulfone resin include methanol, ethanol, isopropyl alcohol, hexane, heptane and water, and methanol is preferable because it is easy to remove.

Further, when a polar organic solvent having a relatively high melting point is used as a polymerization solvent, the reaction mixture obtained in the second step is cooled and solidified, and then pulverized, and while extracting and removing the unreacted alkali metal salt of carbonic acid and the alkali halide generated as a by-product from the obtained powder using water, it is also possible to extract and remove the polar organic solvent using a solvent having no solvency for the aromatic polysulfone resin and having solvency for the polar organic solvent.

Further, as another typical method for producing an aromatic polysulfone resin, a method including: as a first step, reacting an aromatic dihydroxy compound and an alkali metal salt of carbonic acid in an organic polar solvent and removing water generated as a by-product; as a second step, adding an aromatic dihalogenosulfone compound to the reaction mixture obtained in the first step to carry out polycondensation; and as a third step, as described earlier, removing an unreacted alkali metal salt of carbonic acid, an alkali halide generated as a by-product and the polar organic solvent from the reaction mixture obtained in the second step to obtain an aromatic polysulfone resin can be mentioned.

It should be noted that in this alternative method, azeotropic dehydration may be carried out by adding an organic solvent which is azeotroped with water in order to remove the water generated as a by-product in the first step. Examples of the organic solvent which is azeotroped with water include benzene, chlorobenzene, toluene, methyl isobutyl ketone, hexane and cyclohexane. The temperature of the azeotropic dehydration is usually from 70 to 200° C.

Further, in this alternative method, the polycondensation temperature in the second step is usually from 40 to 180° C., and as described earlier, in consideration of the degree of side reactions, it is necessary to adjust the polycondensation temperature and polycondensation time so that an aromatic polysulfone resin having the predetermined reduced viscosity can be obtained.

The basis weight of the nonwoven fabric of the present embodiment is 5 $g/m^2$ or more and 30 $g/m^2$ or less, preferably 10 $g/m^2$ or more and 25 $g/m^2$ or less, more preferably 12 $g/m^2$ or more and 25 $g/m^2$ or less, and particularly preferably 22 $g/m^2$ or more and 25 $g/m^2$ or less. If the basis weight of the nonwoven fabric of the present embodiment is in this range, for example, in the case of forming a composite laminate in which the nonwoven fabric of the present embodiment is sandwiched between two prepregs impregnated with an epoxy resin, the contact area at the interface between the nonwoven fabric and the prepreg increases. As a result, a laminate in which delamination is unlikely to occur can be obtained.

Further, an average fiber diameter of the fibers which use the aromatic polysulfone resin as a forming material is 3 μm or more and 8 μm or less, preferably 5 μm or more and 7 μm or less, and more preferably 5.1 μm or more and 6.9 μm or less. If the average fiber diameter of the fibers constituting the nonwoven fabric of the present embodiment is in this range, the surface of the nonwoven fabric is easily roughened. Therefore, for example, in the case of forming a composite laminate in which the nonwoven fabric of the present embodiment is sandwiched between two prepregs impregnated with an epoxy resin, the contact area at the interface between the nonwoven fabric and the prepreg increases. As a result, a laminate in which delamination is unlikely to occur can be obtained.

A composite laminate using the nonwoven fabric of the present embodiment will be described later.

It should be noted that the expression "the surface of a nonwoven fabric is easily roughened" means that the surface unevenness becomes moderately large.

[Method for Producing Nonwoven Fabric]

Figure 2:
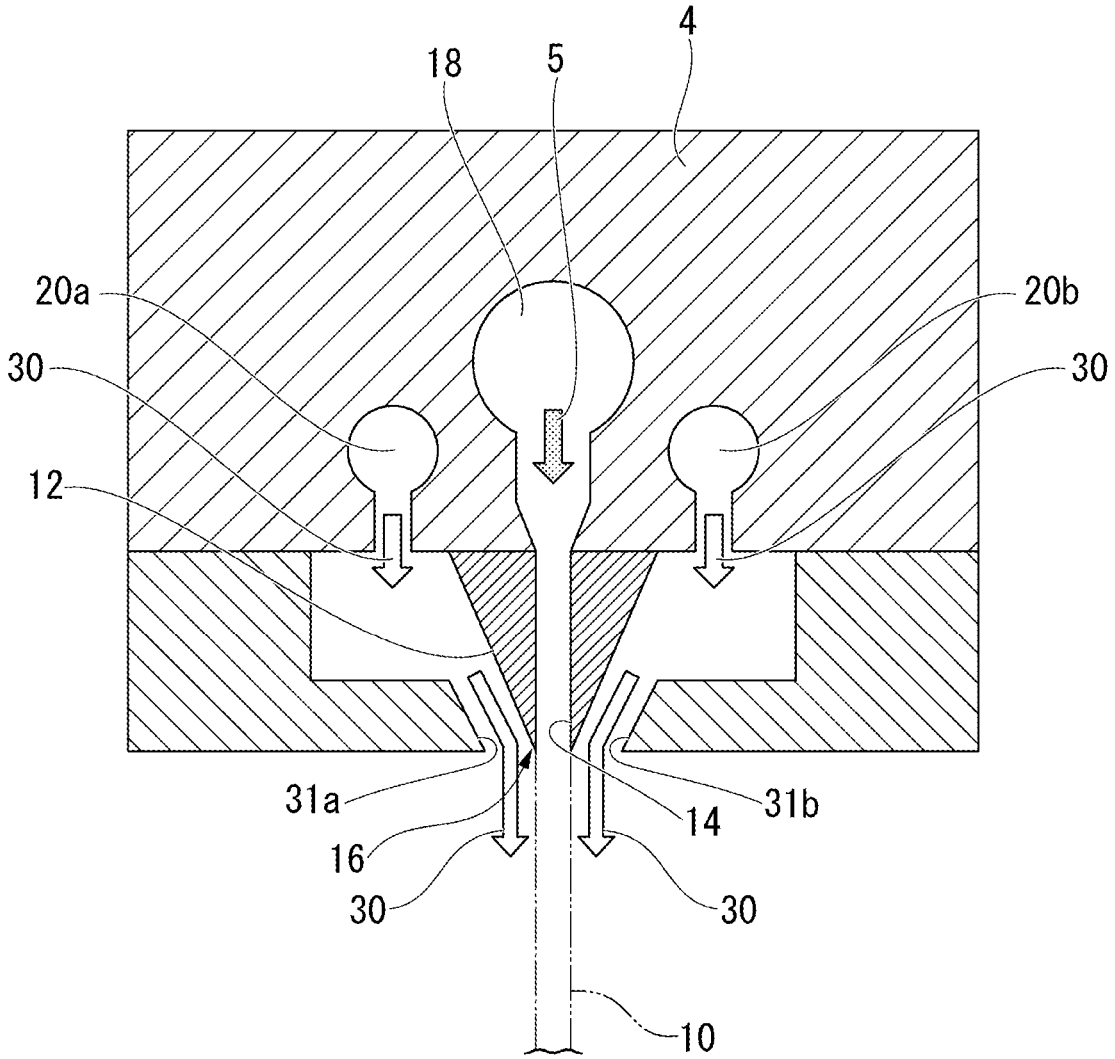
FIG. 2 is a cross-sectional view taken along the line 1141 of a melt blowing die included in the apparatus in FIG. 1.

A melt blowing method will be described as an example of the method for producing the nonwoven fabric of the present embodiment. The melt blowing method does not require a solvent at the time of spinning. Therefore, the nonwoven fabric minimizing the influence of residual solvent can be produced. As a spinning apparatus used for the melt blowing method, a conventionally known melt blowing apparatus can be used. FIG. 1 is a schematic perspective view showing a conventional melt blowing apparatus. FIG. 2 is a cross-sectional view taken along the line II-II of a melt blowing die included in the apparatus in FIG. 1. It should be noted that in the following description, the terms "upstream side" and "downstream side" may be used in accordance with the movement direction of a collecting conveyor 6.

As shown in FIG. 1, a melt blowing apparatus 500 includes a melt blowing die 4, a mesh-like collecting conveyor 6 provided below the melt blowing die 4, and a suction mechanism 8 provided below the collecting conveyor 6.

A take-up roller 11 for winding up a nonwoven fabric 100 is disposed on the downstream side of the melt blowing die 4 and above the collecting conveyor 6. A transport roller 9 for transporting the collecting conveyor 6 is disposed on the downstream side of the take-up roller 11 and below the collecting conveyor 6.

As shown in FIG. 2, a die nose 12 having an isosceles triangular cross-sectional shape is disposed on the lower surface side of the melt blowing die 4. A nozzle 16 in which a plurality of small holes 14 are arranged in a row in the paper penetrating direction is disposed at the center of the tip of the die nose 12. Further, a molten resin 5 supplied into a resin passage 18 is extruded downward from each of the small holes 14 in the nozzle 16. It should be noted that in FIG. 2, only one extruded fiber 10 is shown.

The diameter of the small holes 14 formed in the nozzle 16 is usually in the range of 0.05 mm to 0.4 mm. When the diameter of the small holes 14 is within the above range, the productivity and processing accuracy of the nonwoven fabric are excellent.

The distance between the small holes 14 is usually in the range of 0.01 to 6.0 mm, and preferably 0.15 to 4.0 mm, depending on the average fiber diameter of the nonwoven fabric to be required. When the distance between the holes is within the above range, the dimensional stability and strength of the nonwoven fabric are excellent.

On the other hand, in the melt blowing die 4, a slit 31*a* and a slit 31*b* are formed so as to sandwich the row of the small holes 14 in the nozzle 16 from both sides. A fluid passage 20*a* and a fluid passage 20*b* are configured by the slit 31*a* and the slit 31*b*. Further, a high temperature and high speed fluid 30 sent from the fluid passage 20*a* and the fluid passage 20*b* is ejected obliquely downward when the molten resin 5 is extruded.

The conventional melt blowing apparatus 500 is configured as described above.

A method for producing the nonwoven fabric of the present embodiment includes the following steps (i) to (iii):

(i) melting the aromatic polysulfone resin by an extruder, (ii) spinning the molten aromatic polysulfone resin from a nozzle in which a large number of small holes are arranged and ejecting a high temperature and high velocity fluid from a slit provided so as to sandwich the row of small holes, thereby obtaining a fibrous aromatic polysulfone resin, and (iii) collecting the fibrous aromatic polysulfone resin on a moving collection member.

A method for producing the nonwoven fabric 100 using the melt blowing apparatus 500 shown in FIG. 1 and FIG. 2 will be described.

First, the molten resin 5 obtained by melting the aromatic polysulfone resin by an extruder (not shown) in step (i) is pressure fed to the melt blowing die 4.

Next, in step (ii), the molten resin 5 is spun out from a large number of small holes 14 in the nozzle 16. At the same time, the fluid 30 is ejected from the slits 31*a* and 31*b*. The molten resin 5 is extended by the fluid 30 to obtain the fibers 10.

Furthermore, in step (iii), the fibers 10 are spread uniformly on the collecting conveyor 6 by the suction mechanism 8. Then, the fibers 10 are bonded on the collecting conveyor 6 by self-fusion to form the nonwoven fabric 100. The obtained nonwoven fabric 100 is sequentially wound up by the take-up roller 11.

The cylinder temperature of the extruder in step (i) is from 330° C. to 410° C., preferably from 350° C. to 400° C., and more preferably from 370° C. to 400° C. Within the above range, the higher the cylinder temperature, the less likely the fibrous aromatic polysulfone resin solidifies before being collected by the collecting conveyor 6. Therefore, the fibrous aromatic polysulfone resin can be self-fused to sufficiently form a web of microfibers when being collected on the collecting conveyor 6.

The distance from the melt blowing die 4 to the collecting conveyor 6 may be appropriately changed in accordance with the cylinder temperature. That is, when the cylinder temperature is set relatively high, the above distance may be set relatively long. On the other hand, when the cylinder temperature is set relatively low, the above distance may be set relatively short.

The fluid 30 is not particularly limited as long as it can be usually used in the method for producing a nonwoven fabric by the melt blowing method. Examples of the fluid 30 include air, inert gases such as nitrogen, and the like.

The temperature of the fluid 30 may be set to a temperature higher than the cylinder temperature, for example, may be a temperature 20 to 50° C. higher than the cylinder temperature, and a temperature higher by 50° C. is preferable. For example, when the temperature of the fluid 30 is higher than the cylinder temperature by 50° C., it is difficult to cool the aromatic polysulfone resin. Therefore, the fibrous aromatic polysulfone resin is easily self-fused to sufficiently form a web of microfibers when being collected on the collecting conveyor 6.

It should be noted that the term "web" means a thin film-like sheet composed only of fibers.

The ejection amount of the fluid 30 may be set according to the average fiber diameter of the fibers constituting the nonwoven fabric to be required. In the nonwoven fabric of the present embodiment, the ejection amount of the fluid 30 is in the range of 500 L/min or more and 900 L/min or less, preferably in the range of 550 L/min or more and 850 L/min or less, and more preferably in the range of 600 L/min or more and 850 L/min or less. When the ejection amount of the fluid 30 is within this range, it is easy to control the average fiber diameter of the fibers constituting the nonwoven fabric to the range of 3 μm or more and 8 μm or less. Further, within this range, the molten aromatic polysulfone resin is likely to be extended, and the average fiber diameter of the nonwoven fabric tends to be smaller, as the ejection amount of the fluid 30 increases. If the ejection amount of the fluid 30 is 900 L/min or less, the flow of the fluid 30 is unlikely to be disturbed, and a nonwoven fabric can be stably obtained.

In one aspect, the high temperature and high velocity fluid is at a temperature 20 to 50° C. higher than the cylinder temperature, preferably a temperature higher than the cylinder temperature by 50° C., and is a fluid ejected at 500 L/min or more and 900 L/min or less, preferably 550 L/min or more and 850 L/min or less, and more preferably 600 L/min or more and 850 L/min or less.

A single hole discharge amount of the aromatic polysulfone resin is usually 0.05 g/min or more and 3.0 g/min or less, and preferably in the range of 0.1 g/min or more and 2.0 g/min or less. When the discharge amount of the aromatic polysulfone resin is 0.05 g/min or more, the productivity improves. On the other hand, when the discharge amount of the aromatic polysulfone resin is 3.0 g/min or less, the molten aromatic polysulfone resin can be sufficiently extended.

The moving speed of the collecting conveyor 6 may be set in accordance with the basis weight of the required nonwoven fabric. In the nonwoven fabric of the present embodiment, the moving speed of the collecting conveyor 6 is in the range of 1 m/min or more and 20 m/min or less, preferably in the range of 3 m/min or more and 15 m/min or less, and more preferably in the range of 5.5 m/min or more and 7.5 m/min or less. In another aspect, it may be more than 3.2 m/min and less than 7.0 m/min.

When the moving speed of the collecting conveyor 6 is within this range, it is easy to control the basis weight of the obtained nonwoven fabric to 5 g/m$^2$ or more and 30 g/m$^2$ or less. The collecting conveyor 6 may be set to room temperature (15 to 30° C.), but may be heated (for example, 30 to 100° C.) if necessary.

The distance from the nozzle 16 to the collecting conveyor 6 is not particularly limited, but it is preferably set to 10 mm or more and 30 mm or less, more preferably 15 mm or more and 25 mm or less, and still more preferably 15 mm or more and 20 mm or less. If the distance from the nozzle 16 to the collecting conveyor 6 is 30 mm or less, a web composed of microfibers using an aromatic polysulfone resin as a forming material can be sufficiently formed when being collected on the collecting conveyor 6. Therefore, according to the above conditions, a nonwoven fabric excellent in mechanical properties can be obtained.

In this manner, the nonwoven fabric of the present embodiment is produced.

[Composite Laminate]

Figure 3:
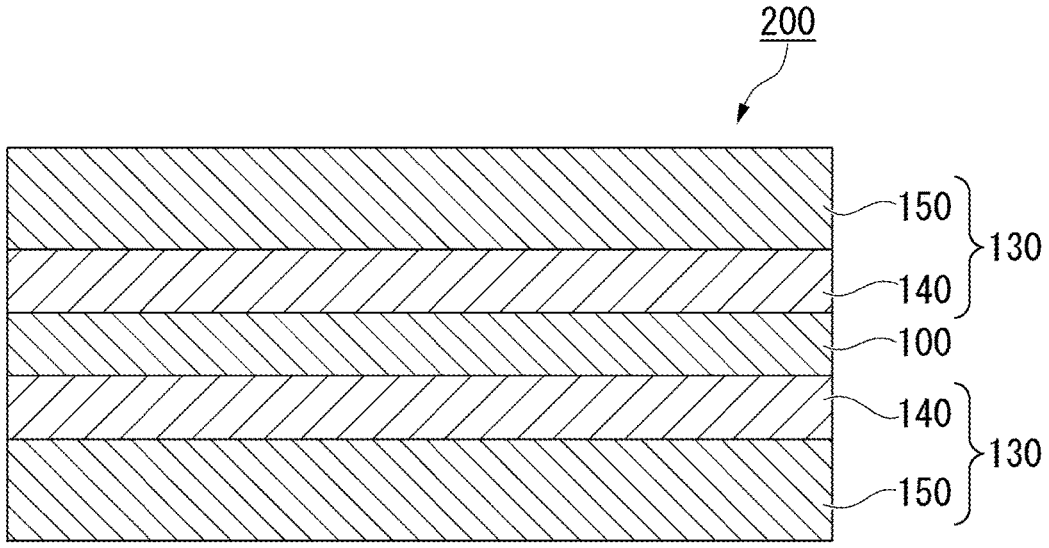
FIG. 3 is a schematic cross-sectional view showing a layer configuration of a composite laminate in which a nonwoven fabric according to an embodiment of the present invention can be suitably used.

Hereinafter, a composite laminate in which the nonwoven fabric of the present embodiment can be suitably used will be described. FIG. 3 is a schematic cross-sectional view showing a layer configuration of a composite laminate in which the nonwoven fabric of the present embodiment can be suitably used.

A composite laminate 200 shown in FIG. 3 includes a nonwoven fabric 100 and laminates 130 pasted onto both surfaces of the nonwoven fabric 100. The laminates 130 include a prepreg 140 in which a fiber sheet is impregnated with a thermosetting resin, and a conductive layer 150 pasted onto one surface of the prepreg 140. In each of the two laminates 130, the surface on the prepreg 140 side is in contact with the nonwoven fabric 100.

It should be noted that in the composite laminate 200, if necessary, a layer other than the fiber sheet impregnated with the thermosetting resin may be included between the prepreg 140 and the conductive layer 150.

(Prepreg)

As the prepreg 140 constituting the composite laminate 200 in which the nonwoven fabric of the present embodiment can be suitably used, a sheet-like intermediate base material for molding in which an epoxy resin in a B-stage state is impregnated into a reinforcing fiber (that is, a fiber sheet) can be used. Here, the term "B-stage resin" means "thermosetting resin at an intermediate stage of curing reaction" defined in JIS-C 5603 (Terms and definitions for printed circuits). Further, the term "B-stage state" means a cured intermediate state of an epoxy resin. Since an epoxy resin in the B-stage state has a low molecular weight (degree of polymerization), it exhibits a behavior as a thermoplastic resin that softens when heated. The prepreg is a sheet-like intermediate base material for molding in which such an epoxy resin in the B-stage state is impregnated into a reinforcing fiber.

Examples of the epoxy resin used for the prepreg 140 include bisphenol type epoxy resins such as bisphenol A epoxy resins, bisphenol F epoxy resins, bisphenol S epoxy resins, bisphenol E epoxy resins, bisphenol M epoxy resins, bisphenol P epoxy resins and bisphenol Z epoxy resins; novolac type epoxy resins such as phenol novolac type epoxy resins and cresol novolac type epoxy resins; biphenyl type epoxy resins; biphenyl aralkyl type epoxy resins; aryl alkylene type epoxy resins; naphthalene type epoxy resins; anthracene type epoxy resins; phenoxy type epoxy resins; dicyclopentadiene type epoxy resins; norbornene type epoxy resins; adamantane type epoxy resins; fluorene type epoxy resins; glycidyl amine type epoxy resins such as N,N,O-triglycidyl-m-aminophenol, N,N,O-triglycidyl-p-aminophenol, N,N,O-triglycidyl-4-amino-3-methylphenol, N,N,N',N'-tetraglycidyl-4,4'-methylenedianiline, N,N,N',N'-tetraglycidyl-2,2'-diethyl-4,4'-methylenedianiline, N,N,N',N'-tetraglycidyl-m-xylylenediamine, N,N-diglycidylaniline and N,N-diglycidyl-o-toluidine; and epoxy resins such as resorcin diglycidyl ether and triglycidyl isocyanurate in B-stage states.

As the B-staged epoxy resin contained in the prepreg 140, one of these may be used alone, or two or more of these may be used in combination. Further, two or more types of resins having different mass average molecular weights can also be used in combination.

Furthermore, as a forming material of the prepreg 140, in addition to the above-mentioned epoxy resins, if required, a thermosetting resin other than the above-described epoxy resins may be used within the range where the effects of the invention can be achieved.

As the thermosetting resin other than such epoxy resins, for example, phenol resins including resol-type phenol resins such as non-modified resol phenol resins and oil modified resol phenol resins modified with oil such as tung oil, linseed oil and walnut oil, resins having a triazine ring such as urea resins and melamine resins, unsaturated polyester resins, bismaleimide resins (BT resins), polyurethane resins, diallyl phthalate resins, silicone resins, resins having a benzoxazine ring, cyanate resins, vinyl ester resins, polyimide resins and the like can be mentioned.

Furthermore, as a forming material of the prepreg 140, in addition to the above-mentioned epoxy resins, a curing agent may be used if required. As the curing agent, a known agent can be used.

For example, organic metal salts such as zinc naphthenate, cobalt naphthenate, tin octylate, bis(acetylacetonato) cobalt(II) and tris(acetylacetonato)cobalt(III), polyaminebased curing agents such as diethylenetriamine, triethylenetetramine, tetraethylenepentamine, diethylaminopropylamine, polyamidepolyamine, menthenediamine, isophoronediamine, N-aminoethyl piperazine, 3,9-bis(3-aminopropyl)-2,4,8,10-tetraoxaspiro[5,5] undecane adducts, bis(4-amino-3-methylcyclohexyl)methane, bis(4-aminocyclohexyl)methane, m-xylenediamine, di aminodiphenylmethane, diaminodiphenylsulfone, m-phenylenediamine, dicyandiamide and hydrazine adipate, acid anhydride-based curing agents such as phthalic anhydride, tetrahydrophthalic anhydride, hexahydrophthalic anhydride, methyltetrahydrophthalic anhydride, methylhexahydrophthalic anhydride, nadic methyl anhydride, dodecyl succinic anhydride, chlorendic anhydride, pyromellitic anhydride, benzophenone tetracarboxylic anhydride, ethylene glycol bis(anhydrotrimate), methyl cyclohexene tetracarboxylic anhydride, trimellitic anhydride and polyazelaic anhydride, tertiary amine compound-based curing agents such as benzyldimethylamine, 2-(dimethylaminomethyl)phenol, 2,4,6-tri(diaminomethyl)phenol, tri-2-ethylhexyl acid salts of 2,4,6-tri(diaminomethyl)phenol, triethylamine, tributylamine and diazabicyclo[2.2.2]octane, imidazole compound-based curing agents such as 2-methylimidazole, 2-phenyl-4-methylimidazole, 2-ethyl-4-methylimidazole, 2,4-diethylimidazole, 2-phenylimidazole, 2-phenyl-4-methylimidazole, 2-phenyl-4-methyl-5-hydroxyimidazole, 2-phenyl-4,5-dihydroxyimidazole, 2-undecylimidazole, 2-heptadecylimidazole, 1-benzyl-2-methylimidazole, 1-cyanoethyl-2-methylimidazole, phenol compounds such as phenol, phenol novolac, bisphenol A and nonylphenol, carboxylic acids such as acetic acid, benzoic acid and salicylic acid, organic acids such as p-toluenesulfonic acid, 3,3'-diisopropyl-4,4'-diaminodiphenylmethane, 3,3'-di-t-butyl-4,4'-diaminodiphenylmethane, 3,3'-diethyl-5,5'-dimethyl-4,4'-diaminodiphenylmethane, 3,3'-diisopropyl-5,5'-dimethyl-4,4'-diaminodiphenylmethane, 3,3'-di-t-butyl-5,5'-dimethyl-4,4'-diaminodiphenylmethane, 3,3',5,5'-tetraethyl-4,4'-diaminodiphenylmethane, 3,3'-diisopropyl-5,5'-diethyl-4,4'-diaminodiphenylmethane, 3,3'-di-t-butyl-5,5'-diethyl-4,4'-diaminodiphenylmethane, 3,3',5,5'-tetraisopropyl-4,4'-diaminodiphenylmethane, 3,3'-di-t-butyl-5,5'-diisopropyl-4,4'-diaminodiphenylmethane, 3,3',5,5'-tetra-t-butyl-4,4'-diaminodiphenylmethane, 4,4'-diaminodiphenylmethane, 4,4'-diaminodiphenylsulfone, 3,3'-diaminodiphenylsulfone, m-phenylenedi amine, m-xylylenediamine, diethyltoluenediamine and the like, or mixtures of these compounds can be mentioned.

As the curing agent, one of these compounds including derivatives may be used alone, or two or more types may be used in combination.

Further, the prepreg 140 may be a commercially available thermosetting prepreg, and, for example, prepregs manufactured by Hitachi Chemical Co., Ltd., Panasonic Electric Works Co., Ltd., Risho Kogyo Co., Ltd., Mitsubishi Gas Chemical Company, Inc., Sumitomo Bakelite Co., Ltd., Ube Industries, Ltd., and the like can be used.

As a fiber sheet constituting the prepreg 140 of the present embodiment, various sheets can be used in accordance with the type of fibers constituting the fiber sheet. Examples of fibers constituting the fiber sheet include inorganic fibers such as glass fibers, carbon fibers and ceramic fibers, liquid crystalline polyester fibers and other polyester fibers, and organic fibers such as aramid fibers and polybenzazole fibers.

The fiber sheet may be formed using two or more of these fibers. As a fiber sheet constituting the prepreg 140, those composed from glass fibers or carbon fibers are preferable.

The fiber sheet may be a fabric (woven fabric), a knitted fabric or a nonwoven fabric. The fiber sheet is preferably a woven fabric because the dimensional stability of the impregnated base material can be easily improved.

The thickness of the fiber sheet is preferably 10 μm or more and 200 μm or less, more preferably 30 μm or more and 150 μm or less, still more preferably 50 μm or more and 140 μm or less, and particularly preferably 70 μm or more and 130 μm or less.

The term "thickness" referred to here is a value measured by the method based on JIS K 7130.

It should be noted that in the composite laminate 200 shown in FIG. 1, although the prepreg 140 is shown as a single prepreg, it is not limited thereto as long as the epoxy resin in a B-stage state is exposed on the surface. The expression "exposed on the surface" as used herein means a state in which when the prepreg is brought into contact with another object, the object and the B-staged epoxy resin are brought into contact. For example, the prepreg 140 may be a laminate in which two or more prepregs are laminated. The two or more prepregs may be the same type or different types.

(Conductive Layer)

As a forming material of the conductive layer 150, for example, a metal material that can be used as a wiring material is suitably used. As a result, by processing the conductive layer 150 of the composite laminate 200, it can be used as a wiring. Examples of the metal material used for the conductive layer 150 include copper, aluminum and silver. As a metal material used for the conductive layer 150, copper is preferable from the viewpoints of high conductivity and low cost.

The thickness of the conductive layer is preferably 10 μm or more and 75 μm or less.

The thickness of the conductive layer can be measured by a micrometer.

The composite laminate using the nonwoven fabric of the present embodiment has such a configuration. In the composite laminate using the nonwoven fabric of the present embodiment, it is preferable to use those formed of the same forming material as the laminates 130. As a result, warpage of the obtained composite laminate can be suppressed and reduced. Similarly, it is preferable to use those having the same thickness as the laminates 130. As a result, warpage of the obtained composite laminate can be suppressed and reduced.

It should be noted that although the composite laminate 200 having the conductive layer 150 on both sides is illustrated in FIG. 3, it may be a composite laminate having a conductive layer only on one side.

[Method for Producing Composite Laminate]

Hereinafter, a method for producing a composite laminate containing the nonwoven fabric of the present embodiment will be described. First, the conductive layer 150, the prepreg 140, the nonwoven fabric 100, the prepreg 140 and the conductive layer 150 are laminated in this order. Next, these laminated materials are collectively subjected to thermocompression bonding using a conventionally known press machine, thereby forming the composite laminate 200.

The temperature at the time of thermocompression bonding of the above laminated materials is preferably 130° C. or more, and more preferably 140° C. or more and 200° C. or less. Further, the pressure at the time of thermocompression bonding of the above laminated materials is preferably 0.5 MPa or more and 7 MPa or less, and more preferably 1 MPa or more and 5 MPa or less.

In this manner, the composite laminate using the nonwoven fabric of the present embodiment can be produced.

Conventionally, as a configuration in which two prepregs are laminated, there is a laminate in which a sheet-like base material is sandwiched and held between two prepregs. In the composite laminate using the nonwoven fabric of the present embodiment, the epoxy resin penetrates into the nonwoven fabric 100 from the prepreg 140 when the two prepregs are subjected to thermocompression bonding. At this time, since the nonwoven fabric 100 has voids, the contact area with the epoxy resin is larger than that of the sheet-like base material. As a result, the adhesion between the nonwoven fabric 100 and the prepreg 140 is improved.

As described above, the basis weight of the nonwoven fabric of the present embodiment is 5 g/m$^2$ or more and 30 g/m$^2$ or less. When the basis weight of the nonwoven fabric is 5 g/m$^2$ or more, an amount of the epoxy resin necessary for bonding the two prepregs 140 can penetrate into the voids of the nonwoven fabric 100 from the prepreg 140 at the time of thermocompression bonding of the two prepregs 140.

On the other hand, when the basis weight of the nonwoven fabric of the present embodiment is 30 g/m$^2$ or less, a region where the epoxy resin does not penetrate into the nonwoven fabric 100 hardly occurs and the epoxy resin can sufficiently penetrate into the nonwoven fabric 100 from the prepreg 140 at the time of thermocompression bonding of the two prepregs 140.

Further, as described above, in the nonwoven fabric of the present embodiment, the average fiber diameter of the fibers formed from the aromatic polysulfone resin is 3 μm or more and 8 μm or less. When the average fiber diameter of the nonwoven fabric 100 is 3 μm or more, an amount of the epoxy resin necessary for bonding the two prepregs 140 can penetrate into the voids of the nonwoven fabric 100 from the prepreg 140 at the time of thermocompression bonding of the two prepregs 140.

On the other hand, when the average fiber diameter of the nonwoven fabric of the present embodiment is 8 μm or less, a region where the epoxy resin does not penetrate into the nonwoven fabric 100 hardly occurs and the epoxy resin can sufficiently penetrate into the nonwoven fabric 100 from the prepreg 140 at the time of thermocompression bonding of the two prepregs 140.

Therefore, in the composite laminate 200 using the nonwoven fabric 100 of the present embodiment, the contact area between the epoxy resin and the nonwoven fabric 100 increases. As a result, the adhesion between the nonwoven fabric 100 and the prepreg 140 is improved. From the above description, in the composite laminate 200 using the nonwoven fabric 100 of the present embodiment, delamination is unlikely to occur between the two prepregs.

Although the preferred embodiments according to the present invention have been described above with reference to the accompanying drawings, it goes without saying that the present invention is not limited to such examples. Various shapes, combinations, and the like for the respective constituent members shown in the above-described example are merely examples, and various changes and modifications can be made based on design requirements or the like without departing from the spirit and scope of the present invention.

Another aspect of the nonwoven fabric of the present embodiment is a nonwoven fabric composed of fibers formed from a thermoplastic resin, wherein the aforementioned thermoplastic resin is an aromatic polysulfone resin in which a content of a repeating unit represented by the above formula (1) is from 80 mol % to 100 mol % with respect to the total amount of all the repeating units constituting the aforementioned thermoplastic resin, preferably an aromatic polysulfone resin obtained by polycondensation of bis(4-hydroxyphenyl) sulfone and bis (4-chlorophenyl) sulfone;

an average fiber diameter of the aforementioned fibers is 3 μm or more and 8 μm or less, preferably 5 μm or more and 7 μm or less, and more preferably 5.1 μm or more and 6.9 μm or less; and a basis weight is 5 g/m$^2$ or more and 30 g/m$^2$ or less, preferably 10 g/m$^2$ or more and 25 g/m$^2$ or less, more preferably 12 g/m$^2$ or more and 25 g/m$^2$ or less, and particularly preferably 22 g/m$^2$ or more and 25 g/m$^2$ or less.

Furthermore, the nonwoven fabric may have a 90° peel strength of 10 N/cm or more, preferably 12 N/cm or more and 14 N/cm or less, when pasted onto a prepreg impregnated with an epoxy resin.

Another aspect of the present invention is a composite laminate containing a nonwoven fabric composed of fibers formed from a thermoplastic resin, and laminates pasted onto both surfaces of the aforementioned nonwoven fabric, wherein the aforementioned laminate includes a prepreg in which a reinforcing fiber is impregnated with a B-staged epoxy resin, and a conductive layer pasted onto one surface of the aforementioned prepreg, and in the aforementioned laminate, the surface on the aforementioned prepreg side is in contact with the aforementioned nonwoven fabric;

the thermoplastic resin constituting the aforementioned nonwoven fabric is an aromatic polysulfone resin in which a content of a repeating unit represented by the above formula (1) is from 80 mol % to 100 mol % with respect to the total amount of all the repeating units constituting the aforementioned thermoplastic resin, preferably an aromatic polysulfone resin obtained by polycondensation of bis(4-hydroxyphenyl) sulfone and bis(4-chlorophenyl) sulfone;

an average fiber diameter of the fibers constituting the aforementioned nonwoven fabric is 3 μm or more and 8 μm or less, preferably 5 μm or more and 7 μm or less, and more preferably 5.1 μm or more and 6.9 μm or less; and a basis weight of the aforementioned nonwoven fabric is 5 g/m$^2$ or more and 30 g/m$^2$ or less, preferably 10 g/m$^2$ or more and 25 g/m$^2$ or less, more preferably 12 g/m$^2$ or more and 25 g/m$^2$ or less, and particularly preferably 22 g/m$^2$ or more and 25 g/m$^2$ or less.

EXAMPLES

The present invention will be described below based on examples. However, the present invention is not limited to these examples.

<Production of Aromatic Polysulfone Resin>

An aromatic polysulfone resin used in the examples was produced by the following method. It should be noted that the physical properties of the produced aromatic polysulfone resin were measured in the following manner.

[Measurement of Reduced Viscosity]

1 g of an aromatic polysulfone resin was dissolved in N,N-dimethylformamide to adjust the volume to 1 dL. The viscosity (η) of this solution was measured at 25° C. using an Ostwald type viscosity tube. In addition, the viscosity (no) of N,N-dimethylformamide as a solvent was measured at 25° C. using an Ostwald type viscosity tube. Since the concentration of the above solution is 1 g/dL, the value of the specific viscosity $((\eta-\eta_0)/\eta_0)$ will be the value of the reduced viscosity in the unit of dL/g.

Production Example 1

500 g of 4,4'-dihydroxydiphenyl sulfone, 600 g of 4,4'-dichlorodiphenyl sulfone and 978 g of diphenyl sulfone as a polymerization solvent were charged into a polymerization vessel equipped with a stirrer, a nitrogen inlet tube, a thermometer and a condenser attached with a receiver at the tip thereof, and the temperature was raised to 180° C. at the polymerization temperature indicated by the above-mentioned thermometer while causing nitrogen gas to circulate inside the system. After adding 287 g of potassium carbonate to the obtained solution, the temperature was gradually raised to 290° C., and the reaction was further carried out at 290° C. for 4 hours. The obtained reaction solution was cooled to room temperature to solidify and finely pulverized, and then washed with warm water, and further washed several times with a mixed solvent of acetone and methanol. Subsequently, the resultant was dried by heating at 150° C. to obtain an aromatic polysulfone resin in the form of a powder.

As a result of measuring the reduced viscosity of this aromatic polysulfone resin, the reduced viscosity was 0.31 dL/g.

Subsequently, the obtained aromatic polysulfone resin was supplied to a cylinder of a twin screw extruder ("PCM-30 model" manufactured by Ikegai Ironworks Corp), and melt-kneaded at a cylinder temperature of 360° C. and extruded, thereby obtaining a strand. By cutting this strand, pellets of the aromatic polysulfone resin were obtained.

Production Example 2

500 g of 4,4'-dihydroxydiphenyl sulfone, 594 g of 4,4'-dichlorodiphenyl sulfone and 970 g of diphenyl sulfone as a polymerization solvent were charged into a polymerization vessel equipped with a stirrer, a nitrogen inlet tube, a thermometer and a condenser attached with a receiver at the tip thereof, and the temperature was raised to 180° C. at the polymerization temperature indicated by the above-mentioned thermometer while causing nitrogen gas to circulate inside the system. After adding 287 g of potassium carbonate to the obtained solution, the temperature was gradually raised to 290° C., and the reaction was further carried out at 290° C. for 4 hours. The obtained reaction solution was cooled to room temperature to solidify and finely pulverized, and then washed with warm water, and further washed several times with a mixed solvent of acetone and methanol. Subsequently, the resultant was dried by heating at 150° C. to obtain an aromatic polysulfone resin in the form of a powder.

As a result of measuring the reduced viscosity of this aromatic polysulfone resin, the reduced viscosity was 0.41 dL/g.

Subsequently, the obtained aromatic polysulfone resin was supplied to a cylinder of a twin screw extruder ("PCM-30 model" manufactured by Ikegai Ironworks Corp), and melt-kneaded at a cylinder temperature of 360° C. and extruded, thereby obtaining a strand. By cutting this strand, pellets of the aromatic polysulfone resin were obtained.

<Production of Meltblown Nonwoven Fabric>

Using the aromatic polysulfone resins of Production Example 1 and Production Example 2, meltblown nonwoven fabrics using an aromatic polysulfone resin as a forming material were produced. It should be noted that each measurement of the produced nonwoven fabric was performed as follows.

[Measurement of Basis Weight]

Each nonwoven fabric was cut into a size of 100 mm square and used as a test piece. The mass of this test piece was measured and converted to the mass per 1 $m^2$, thereby calculating the basis weight.

[Measurement of Average Fiber Diameter]

Each nonwoven fabric was magnified and photographed with a scanning electron microscope to obtain a photograph. Diameters of 20 arbitrarily chosen fibers were measured from the obtained photograph, and the average value thereof was used as the average fiber diameter.

Example 1

A meltblown nonwoven fabric using the aromatic polysulfone resin of Production Example 1 as a forming material was produced using a meltblown nonwoven fabric production apparatus configured in the same manner as that of the apparatus shown in FIG. 1 and having a nozzle with 201 holes. The details will be described below.

First, the aromatic polysulfone resin of Production Example 1 was extruded by a single screw extruder and melted at a cylinder temperature of 400° C. Next, the molten resin was supplied to a melt blowing die of the meltblown nonwoven fabric production apparatus. Further, the molten resin was extruded from the holes (small holes) of the nozzle provided in the melt blowing die. At the same time, hot air (high temperature and high velocity fluid) was ejected from slits on both sides of the nozzle to extend the extruded aromatic polysulfone resin. Furthermore, the obtained fibrous aromatic polysulfone resin was collected on a collecting conveyor made of a stainless steel wire mesh installed below the nozzle to form a meltblown nonwoven fabric. The production conditions of Example 1 are shown in Table 1.

The basis weight of the meltblown nonwoven fabric of Example 1 was 12 g/$m^2$. Further, the average fiber diameter of the fibers constituting this meltblown nonwoven fabric was 5.4 μm.

Example 2

A meltblown nonwoven fabric was obtained in the same manner as in Example 1, except that the moving speed of the collecting conveyor was changed to the value shown in Table 1.

The basis weight of the meltblown nonwoven fabric of Example 2 was 22 g/$m^2$. Further, the average fiber diameter of the fibers constituting this meltblown nonwoven fabric was 5.1 μm.

Example 3

A meltblown nonwoven fabric was obtained in the same manner as in Example 1, except that the amount of hot air supplied and the moving speed of the collecting conveyor were changed to the values shown in Table 1.

The basis weight of the meltblown nonwoven fabric of Example 3 was 25 g/$m^2$. Further, the average fiber diameter of the fibers constituting this meltblown nonwoven fabric was 6.9 μm.

Comparative Example 1

A meltblown nonwoven fabric was obtained in the same manner as in Example 1, except that the moving speed of the collecting conveyor was changed to the value shown in Table 1.

The basis weight of the meltblown nonwoven fabric of Comparative Example 1 was 36 g/m$^2$. Further, the average fiber diameter of the fibers constituting this meltblown nonwoven fabric was 5.3 μm.

Comparative Example 2

A meltblown nonwoven fabric was obtained in the same manner as in Example 1, except that the amount of hot air supplied and the moving speed of the collecting conveyor were changed to the values shown in Table 1, using the aromatic polysulfone resin of Production Example 2.

The basis weight of the meltblown nonwoven fabric of Comparative Example 2 was 14 g/m$^2$. Further, the average fiber diameter of the fibers constituting this meltblown nonwoven fabric was 12.0 μm.

Comparative Example 3

Using the aromatic polysulfone resin of Production Example 2, a meltblown nonwoven fabric using the aromatic polysulfone resin of Production Example 2 as a forming material was produced. The details will be described below.

First, 50 g of the aromatic polysulfone resin of Production Example 2 was added to 150 g of N,N-dimethylacetamide and completely dissolved by heating the mixture to 80° C. to obtain a yellowish brown transparent polymer solution containing the aromatic polysulfone resin. Next, the obtained polymer solution was subjected to electrostatic spinning under conditions of a nozzle inner diameter of 1.0 min and a voltage of 10 kV by a known electrostatic spinning apparatus to form a meltblown nonwoven fabric on a collecting electrode.

The basis weight of the meltblown nonwoven fabric of Comparative Example 3 was 2 g/m$^2$. Further, the average fiber diameter of the fibers constituting this meltblown nonwoven fabric was 1.0 μm.

TABLE 1

| | | Ex. 1 | Ex. 2 | Ex. 3 | Comp. Ex. 1 | Comp. Ex. 2 | Comp. Ex. 3 |
|---|---|---|---|---|---|---|---|
| Production conditions of nonwoven fabric | Cylinder temperature [° C.] | 400 | 400 | 400 | 400 | 400 | |
| | Hot air temperature [° C.] | 450 | 450 | 450 | 450 | 450 | |
| | Amount of hot air supplied [L/min] | 850 | 850 | 600 | 850 | 450 | |
| | Moving speed of collecting conveyor [m/min] | 7.5 | 5.5 | 5.5 | 3.2 | 7.0 | |
| Nonwoven fabric | Basis weight [g/m$^2$] | 12 | 22 | 25 | 36 | 14 | 2 |
| | Average fiber diameter [μm] | 5.4 | 5.1 | 6.9 | 5.3 | 12.0 | 1.0 |

<Evaluation>

The following evaluations were carried out for each of the nonwoven fabrics of Examples 1 to 3 and Comparative Examples 1 to 3. The results are shown in Table 2.

[Compatibility with Epoxy Resin]

The compatibility between the produced nonwoven fabric and an epoxy resin was evaluated by forming a composite laminate using a prepreg in which glass fibers were impregnated with an epoxy resin (hereinafter sometimes referred to as a prepreg) and the nonwoven fabric, and measuring a 90° peel strength of this composite laminate. The details will be described below.

[Production of Composite Laminate]

Figure 4:
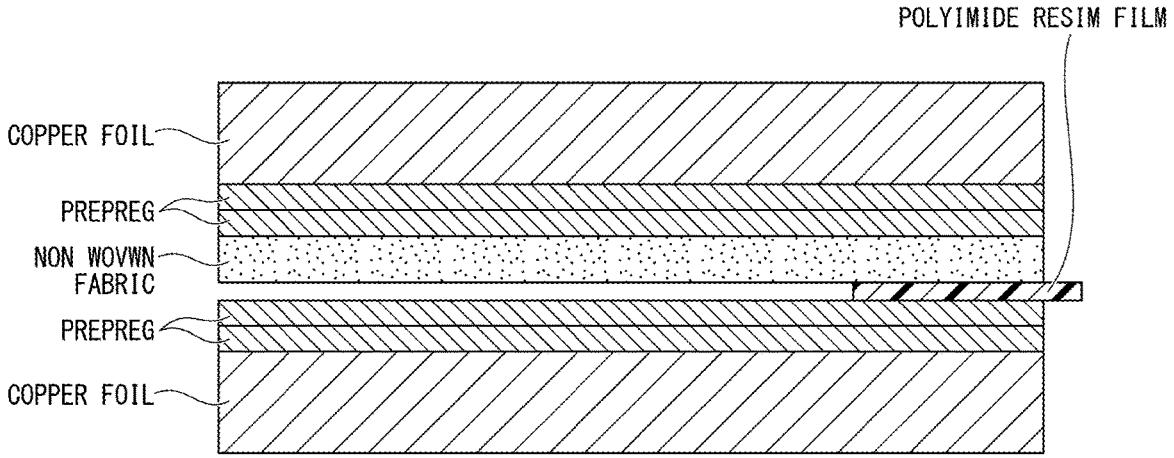
FIG. 4 is a schematic cross-sectional view showing a layer configuration of a composite laminate in an example.

FIG. 4 is a schematic cross-sectional view showing a layer configuration of a composite laminate using each of the nonwoven fabrics of Examples 1 to 3 and Comparative Examples 1 to 3.

As shown in FIG. 4, a copper foil, two prepreg layers, a polyimide resin film, a nonwoven fabric, two prepreg layers and a copper foil were laminated in this order. This product was subjected to press molding for 30 minutes under conditions of a temperature of 150° C. and a pressure of 4.9 MPa using a press machine TA-200-1 W manufactured by Yamamoto Eng. Works Co., Ltd., thereby producing a composite laminate.

Further, a composite laminate which did not use a nonwoven fabric containing an aromatic polysulfone resin as a forming material was produced as a reference example.

It should be noted that the following materials were used.

Copper foil: "GP-35" manufactured by Nippon Denkai, Ltd., thickness: 35 μm

Prepreg in which glass fibers are impregnated with epoxy resin: "5100 (0.10)" manufactured by Teraoka Seisakusho Co., Ltd.

Polyimide resin film: "UPILEX 75S" manufactured by Ube Industries, Ltd.

[Measurement of 90° Peel Strength]

Test pieces of 10 mm width were produced using each laminated body produced as described above. The test piece was fixed on a base material made of glass epoxy as a forming material with a double-sided tape. With the base material being fixed, the peel strength of the composite laminate was measured when the copper foil was peeled off at a peeling rate of 50 mm/min in the direction of 90° with respect to the base material. This measurement was performed on three test pieces, and the average value of the three measured values was taken as the 90° peel strength of the composite laminate.

From the measurement results of the 90° peel strength, the compatibility of each nonwoven fabric with the epoxy resin was evaluated based on the following criteria.

A: 90° peel strength of 10 N/cm or more

B: 90° peel strength of less than 10 N/cm

TABLE 2

| | Ex. 1 | Ex. 2 | Ex. 3 | Comp. Ex. 1 | Comp. Ex. 2 | Comp. Ex. 3 | Ref. Ex. |
|---|---|---|---|---|---|---|---|
| Average fiber diameter [μm] | 5.4 | 5.1 | 6.9 | 5.3 | 12.0 | 1.0 | |
| Basis weight [g/m$^2$] | 12 | 22 | 25 | 36 | 14 | 2 | |
| 90° peel strength [N/cm] | 12 | 14 | 14 | 9 | 9 | 6 | 5 |
| Compatibility | A | A | A | B | B | B | B |

As shown in Table 2, the composite laminates including the nonwoven fabrics of Examples 1 to 3 employing the present invention were excellent in 90° peel strength. This is thought to be because when the two prepregs were thermo-compression bonded, the epoxy resin easily penetrated into the nonwoven fabric from the prepregs. It is presumed that as a result of the epoxy resin penetrating into the nonwoven fabric from the prepregs, the contact area between the nonwoven fabric and the epoxy resin increased, and the adhesion between the nonwoven fabric and the prepregs improved. From the above results, it can be said that the nonwoven fabrics of Examples 1 to 3 were excellent in compatibility with the epoxy resin.

On the other hand, the composite laminates including the nonwoven fabrics of Comparative Examples 1 to 3 were superior in 90° peel strength, as compared with the reference example in which a nonwoven fabric containing an aromatic polysulfone resin as a forming material was not used. It is presumed that this is because the contact area at the interface between the nonwoven fabric and the prepreg became larger than that at the interface between the prepregs. As a result, in Comparative Examples 1 to 3, it is presumed that the adhesion between the nonwoven fabric and the prepreg improved, as compared with the reference example.

However, the composite laminates including the nonwoven fabrics of Comparative Examples 1 to 3 were inferior in 90° peel strength, as compared with the nonwoven fabrics of Examples 1 to 3. From these results, it can be said that the nonwoven fabrics of Comparative Examples 1 to 3 were inferior in compatibility with the epoxy resin, as compared with Examples 1 to 3.

From the above results, it was confirmed that the present invention is useful.

INDUSTRIAL APPLICABILITY

The present invention is extremely useful industrially because a material excellent in compatibility with an epoxy resin can be provided.

REFERENCE SIGNS LIST

10: Fiber; 100: Nonwoven fabric

The invention claimed is:

1. A nonwoven fabric comprising fibers formed from a thermoplastic resin and optionally a further component selected from the group consisting of a residual solvent, an antioxidant, a heat resistant processing stabilizer and a viscosity modifier, wherein said thermoplastic resin consists of an aromatic polysulfone resin, an average fiber diameter of said fibers is 5.1 μm or more and 8 μm or less, and a basis weight is 5 g/m$^2$ or more and 30 g/m$^2$ or less, wherein a content of a repeating unit represented by the following formula (1) in said aromatic polysulfone resin is from 80 mol % to 100 mol % with respect to a total amount of all the repeating units constituting said aromatic polysulfone resin, $$-Ph^1-SO_2-Ph^2-O— \quad (1)$$

wherein $Ph^1$ and $Ph^e$ each independently represent a phenylene group, and at least one hydrogen atom in said phenylene group may each independently be substituted with an alkyl group having 1 to 10 carbon atoms, an aryl group having 6 to 12 carbon atoms or a halogen atom.

2. The nonwoven fabric according to claim 1, wherein a content of the further component is from 0.1 to 30% by mass with respect to a total mass of the nonwoven fabric.

3. The nonwoven fabric according to claim 1, wherein the fibers are formed from only an aromatic polysulfone resin.

4. The nonwoven fabric according to claim 1, wherein the nonwoven fabric is composed only of fibers formed from only an aromatic polysulfone resin.

5. The nonwoven fabric according to claim 1, wherein the average fiber diameter of said fibers is 5.1 μm or more and 7 μm or less.

6. The nonwoven fabric according to claim 1, wherein the basis weight is 10 g/m$^2$ or more and 25 g/m$^2$ or less.

7. The nonwoven fabric according to claim 6, wherein the basis weight is 22 g/m$^2$ or more and 25 g/m$^2$ or less.

8. A nonwoven fabric comprising fibers formed from a thermoplastic resin and optionally a further component selected from the group consisting of a residual solvent, an antioxidant, a heat resistant processing stabilizer and a viscosity modifier, wherein said thermoplastic resin consists of an aromatic polysulfone resin, an average fiber diameter of said fibers is 5.1 μm or more and 8 μm or less, and a basis weight is 5 g/m$^2$ or more and 30 g/m$^2$ or less, and wherein a content of the further component is from 0.1 to 30% by mass with respect to a total mass of the nonwoven fabric.

9. The nonwoven fabric according to claim 8, wherein the fibers are formed from only an aromatic polysulfone resin.

10. The nonwoven fabric according to claim 8, wherein the average fiber diameter of said fibers is 5.1 μm or more and 7 μm or less.

11. The nonwoven fabric according to claim 8, wherein the basis weight is 10 g/m$^2$ or more and 25 g/m$^2$ or less.

12. The nonwoven fabric according to claim 11, wherein the basis weight is 22 g/m$^2$ or more and 25 g/m$^2$ or less.

13. A nonwoven fabric comprising fibers formed from a thermoplastic resin and optionally a further component selected from the group consisting of a residual solvent, an antioxidant, a heat resistant processing stabilizer and a viscosity modifier, wherein said thermoplastic resin consists of an aromatic polysulfone resin, an average fiber diameter of said fibers is 5.1 μm or more and 7 μm or less, and a basis weight is 5 g/m$^2$ or more and 30 g/m$^2$ or less.

14. The nonwoven fabric according to claim 13, wherein the fibers are formed from only an aromatic polysulfone resin.

15. The nonwoven fabric according to claim 13, wherein the nonwoven fabric is composed only of fibers formed from only an aromatic polysulfone resin.

16. The nonwoven fabric according to claim 13, wherein the basis weight is 10 g/m$^2$ or more and 25 g/m$^2$ or less.

17. The nonwoven fabric according to claim 16, wherein the basis weight is 22 g/m$^2$ or more and 25 g/m$^2$ or less.

* * * * *